US007183564B2

(12) United States Patent
Schulteiss et al.

(10) Patent No.: US 7,183,564 B2
(45) Date of Patent: Feb. 27, 2007

(54) CHANNEL SPARK SOURCE FOR GENERATING A STABLE FOCUSED ELECTRON BEAM

(75) Inventors: Christoph Schulteiss, Berghausen (DE); Lothar-Heinz-Otto Buth, Weingarten (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 399 days.

(21) Appl. No.: 10/915,834

(22) Filed: Aug. 11, 2004

(65) Prior Publication Data

US 2005/0012441 A1 Jan. 20, 2005

Related U.S. Application Data

(63) Continuation-in-part of application No. PCT/EP03/00719, filed on Jan. 24, 2003.

(30) Foreign Application Priority Data

Feb. 25, 2002 (DE) ..... 102 07 835

(51) Int. Cl.
*H01J 17/26* (2006.01)
*H01J 61/28* (2006.01)
*H05H 9/00* (2006.01)

(52) U.S. Cl. ..... 250/492.3; 118/723 EB; 118/723 ER; 313/231.31; 315/4; 315/5; 315/505

(58) Field of Classification Search ..... None
See application file for complete search history.

(56) References Cited

U.S. PATENT DOCUMENTS 4,335,314 A * 6/1982 Geerk et al. ..... 250/492.3
4,748,378 A * 5/1988 Frost et al. ..... 315/39
5,576,593 A * 11/1996 Schultheiss et al. ... 313/231.31
7,122,949 B2 * 10/2006 Strikovski ..... 313/231.31

OTHER PUBLICATIONS

Bluhm H et al. "Industrial Applications of High Voltage Pulsed Power Techniques: Developments at Forschungszentrum Karlsruhe (FZK)", Pulsed Power Conference, 1997 Digest of Technical Papers . . . .

* cited by examiner

*Primary Examiner*—Jack I. Berman
(74) *Attorney, Agent, or Firm*—Klaus J. Bach

(57) ABSTRACT

In a channel spark source triggered by gas discharge for generating a stable focused electron beam, a gas supply for a hollow cathode thereof is provided which generates in the hollow cathode a pressure differential so that the multiplication of charge carriers in a trigger plasma of a trigger plasma source connected to the hollow cathode provides for a reliable gas discharge and the formation of a stable electron beam which exits the arrangement and which does not damage the internal passages of the arrangement.

12 Claims, 3 Drawing Sheets

CHANNEL SPARK SOURCE FOR GENERATING A STABLE FOCUSED ELECTRON BEAM

This is a Continuation-In-Part Application of international application PCT/EP03/00719 filed Jan. 24, 2003 and claiming the priority of German application 102 07 835.1 filed Feb. 25, 2002.

BACKGROUND OF THE INVENTION

The invention relates to a channel spark source for generating a stable focused electron beam comprising, in a co-axial arrangement, a dielectric tube, in which a trigger plasma is generated, and, adjacent thereto, a hollow cathode, a dielectric channel spark body ending at an anode with a central passage, a dielectric tube in alignment with the channel spark body, a condenser connected as an electric energy storage device to the anode and the cathode, an electrode connected by way of a spark gap to a reference potential and an electric resistance bridging the electrode and the hollow cathode. The arrangement corresponds in principle to the arrangement as described in German publication 42 08 764.

The life of the channel spark tube described in DE 198 49 894 is only about 1 million shots. Then the beam has cut a passage into the tube housing wall. Another disadvantage resides in the generation of heat. Beginning at about 50 Hz pulse frequency, a red hot area can be observed in the channel spark tube. At 100 Hz pulse frequency, the tube is heated to a white hot state because of the energy loss.

In order to satisfy industrial standards lifespans of $10^9$ pulses are required as they are standard with Excimer lasers. In an actual situation, the electric power output of the channel spark system is limited at 50 Hz pulse frequencies to about 150 W and the radiation power output is limited to about 60 W. In comparison with other laser or respectively particle accelerators (electron cannon) whose power output is in the 1 KW range, the present power output capability of the channel spark system is too small to serve as a source for process energy.

The reason for the chaotic movement of the beam in the channel spark system, particularly in the area of the anode-side channel spark tube and after leaving this tube is an instability which is similar to the so-called hose instability z-pinches. From the operation of channel spark apparatus, it is known that this instability occurs only after an extended period of operation (about 10000 shots), apparently after the system is warmed up and fully degasified.

It is the object of the present invention to improve existing channel spark gaps or sources in such a way that very high shot numbers of constant beam quality can be achieved and such an improved channel spark source are usable in an industrial plant.

SUMMARY OF THE INVENTION

In a channel spark source triggered by gas discharge for generating a stable focused electron beam, a gas supply for a hollow cathode thereof is provided which generates in the hollow cathode a pressure differential so that the multiplication of charge carriers in a trigger plasma of a trigger plasma source connected to the hollow cathode provides for a reliable gas discharge and the formation of a stable electron beam which exits the arrangement which does not damage the internal passages of the arrangement.

To facilitate the understanding of the invention, the components of the general description have been provided with reference numerals which however have been bracketed.

The basis of the invention resides in establishing a gas cover at the inner wall (3) of the channel tube (4), the hollow cathode and the trigger system (7); it acts like a gas reservoir or, respectively, an inner gas bag which is consumed in time. During this time, no instabilities occur. However, in this phase, the energy content of the beam, that is, the power density is insufficient for an effective ablation. The full beam power density is observed only shortly before the occurrence of the instability.

Based on this observation, a gas supply has been installed in the area of the hollow cathode (1) of the channel spark system and to establish there a gas pressure is established at which the instability does not yet occur while the beam has an energy content suitable for a coating process.

To this end, the sleeve (21), which is part of the hollow cathode (1) extends from the trigger plasma side into the hollow cathode (1) and has an opening which becomes conically larger toward the anode (17) and forms an annular gap (13). Its axial end is spaced from the anode-side end face of the hollow cathode which has the width of the hollow cathode interior and into which the annular gap (13) opens.

The hollow cathode 1 is provided with a gas supply passage or leakage areas through which gas can be supplied, in a dosed manner, into the interior of the hollow cathode (1) for adjusting a predetermined pressure drop between the hollow cathode exit and the exit of the dielectric channel tube (5). These artificial leaks however are so small that no pumping efforts beyond the normal pumping efforts for the differential pumping in the channel spark tube are required so that no additional technical equipment is necessary.

Furthermore, the field of a device for generating a magnetic field, such as a permanent magnet or an electromagnet (12), extends in sections fully through the dielectric tube 7 of the trigger source. The device for generating the magnetic field (12) is movable along the dielectric tube (7). Also, the magnetic field axis can be pivoted. As a result, the charge carriers can be strengthened by electron drift in the trigger plasma and support the discharge of the channel spark discharge after ignition of the trigger plasma.

Preferably, the ratio of the distance between the entrance of the hollow cathode (1) and its exit and the open width of the sleeve (21) at the trigger source side entrance is at least 4, but not more than 10. The opening width of the sleeve (21) at the beam exit end is at least equal to the open width of the channel spark tube (11).

For the dosed gas inlet, a special valve (16) is arranged in the gas inlet line. It comprises a membrane which separates the interior space of the hollow cathode (1) from a higher-pressure gas space and through which the gas passes in small amounts according to the membrane structure, the pressure differential and the set temperature. The membrane may be for example a plastic foil of a thermo-stable material, such as polyester, polyvinyl chloride, silicon rubber or Teflon®.

In another possible arrangement of the dosed gas supply, the seal arrangement at one or both of the end faces of the hollow cathode (1) includes leak structures in the form of a micro-roughness or micro-channels forming micro-passages to the interior of the hollow cathode (1) through which gas can enter into the hollow cathode in a dosed manner. The micro-unevenness or micro-channels are provided in one or both of the two end faces of the hollow cathode housing.

It is also possible that the micro-channel like leak structures are provided in the contact areas of the O-rings with the respective seal surface areas.

Since the open flow cross-section of a passage is responsible for the gas supply a capillary with a squeezed cross-sectional area may be provided for the control of the leak-gas supply. A metallic pipe squeezed at its end or a very fine glass capillary may also be used for the introduction of the leak gas into the hollow cathode.

For changing the dosage of the leak gas flow, instead of the membrane mentioned earlier, a small control valve may be used if the desired leakage rate is higher than that of a membrane.

Experiments have shown that the admission rate of gas, for example air, must be very low that is the pV-flow should be only about $10^{-7}$ mbar·l/sec. If the gas admission is in the area of the hollow cathode (1), and the channel (9) has a diameter of 5 mm, a pressure differential of $10^{-4}$ Pascal is obtained along the whole channel structure (9).

Good results are obtained if the low residual gas pressure present in the whole system increases in the area of the hollow cathode (1) in the direction toward the trigger source (7) constantly by a factor of $10^{-4}$ whereas in the direction toward the anode end side exit a pressure drop exists in the channel spark tube (5).

This extraordinarily small gas supply must be maintained within limits of 50%; otherwise energy losses will occur by instabilities or the power density of the beam drops.

The magnetic field in the area of the dielectric tube (7) of the carrier plasma has the physical importance pointed out already earlier. Such a magnetic field can be applied by way of a permanent magnet (12) in the form of an annular magnet. But it is also possible to use a permanent magnet with pole shoes which are arranged opposite each other at a distance of the diameter of the dielectric tube (7).

However, a uniform magnetic field may also be generated by an electromagnet which is energized by a DC current. In simple rugged apparatus, such an electromagnet is normally conductive but for special applications, it could also be superconductive. This would require a cryostat and such technical expenditures would have to be justified. The electromagnet may include a cylindrical winding or a spiral winding.

For the magnetic field crossing more normal to the channel axis (9), the electromagnet with a coil around a gap-forming iron core would be used.

A criterion for the stability of the self-focusing electron beams from channel spark tubes is the distance range of the beam after leaving the channel spark tube. The greater the distance range or the capability to ablate remote targets 4, the more stable is the quality of the beam. It has been found that the beam, when stabilized by the gas supply may have a distance range which is increased from 5–10 mm to about 90 mm in the open space to the target.

For achieving such optimal beam travel conditions, however, the channel in the hollow cathode (1) must widen conically from the entrance thereof. From the plasma entering the hollow cathode (1) from the trigger plasma source, the electron beam is extracted by the electric field between the anode (17) and the hollow cathode (1). For obtaining a usable electron beam, the following geometrical conditions must be met.

The conical channel of the sleeve (21) should at the connecting point to the dielectric tube (7) have an opening of several square millimeters cross-section and should open up toward the entrance (10) to the channel spark body (11) to the open width thereof, and the length of the sleeve should have a length of between 4 and 10 times the diameter of the channel spark tube (9). A further increase in length results in an undesirable uncoupling between the trigger plasma and the channel spark discharge.

The invention resides in a modification in the area of the hollow cathode which causes the electron beam generated therein to rarely or never come into contact with the inner wall of the channel and change the material layers there by ablation. This, on one hand, has the advantage that the electron beam leaves the channel spark system with unmitigated energy and can subsequently interact with a target. On the other hand the life of the channel spark system is substantially increased thereby.

The channel spark source for generating a focused electron beam will be described below in detail on the basis of the accompanying drawings.

DESCRIPTION OF A PARTICULAR EMBODIMENT

Figure 1:
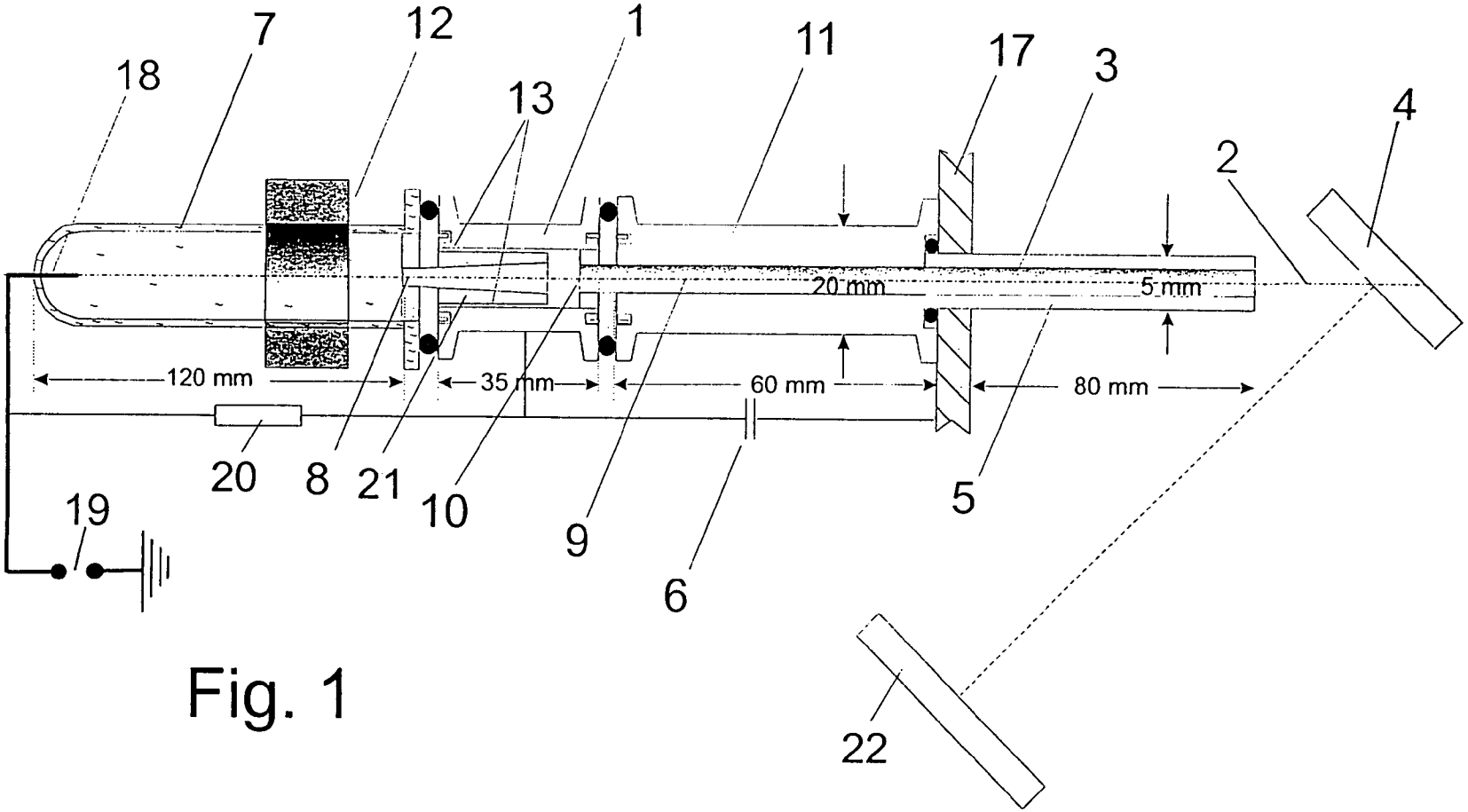
FIG. 1 shows the design of the channel spark source.

FIG. 1 is a cross-sectional view along the longitudinal axis of the channel spark source according to the invention. The channel spark source includes a housing 7 for the trigger plasma which housing is test tube shaped and consists of quartz glass. It is flanged to the hollow cathode 1 in a gas-tight manner by way of a support and a rubber ring 14.

From this coupling location, the conically widening sleeve 21 extends concentrically into the interior of the hollow cathode 1. Between the hollow cathode 1 and the sleeve 2, there is an annular gap 13. The hollow cathode 1 and the sleeve 21 consist of metal. The sleeve 21 ends within the hollow cathode 1. There is still a space at the end of the sleeve 21 with the open diameter of the hollow cathode 1.

At the exit of the hollow cathode 1, there is the channel spark body 11 which forms part of the channel spark tube 9 having an inner wall 3 and is flanged to the hollow cathode 1 like the housing 7 for the trigger plasma. The channel spark body 11 consists of a dielectric material. At the opposite end face of the channel spark body 11, there is the annular anode 17 through which the end section 5 of the channel spark tube 9 extends and abuts the channel spark body 11.

A condenser 6, which forms an electric energy storage device, bridges the hollow cathode and the anode, which are separated from each other electrically by the channel spark body 4. The electrode 18 extends through the end wall of the housing 7 for the trigger plasma source. The electrode 18 is on one hand connected to the hollow cathode 1 by way of the charge resistor 20 and on the other hand, by way of the spark gap 19, to a reference potential which in this case is ground.

The housing 7 for the trigger plasma is preferably simply filled with air. The pressure is 2 Pa and is maintained constant during operation. For the local travel path extension of the electrons in the plasma, the electron drift, and accordingly, for an increase of the charge carrier the annular permanent magnet 12 is moved along the housing 7 and is fixed just ahead of the exit 8 thereof. The magnet is movable to permit adjustment of the quality of the electron beam 2.

The pulsed electron beam 2 generated in the hollow cathode 1 impinges on the target 4 from which it knocks out or vaporizes the exposed target material which is then partially deposited on the substrate 22.

Figure 2:
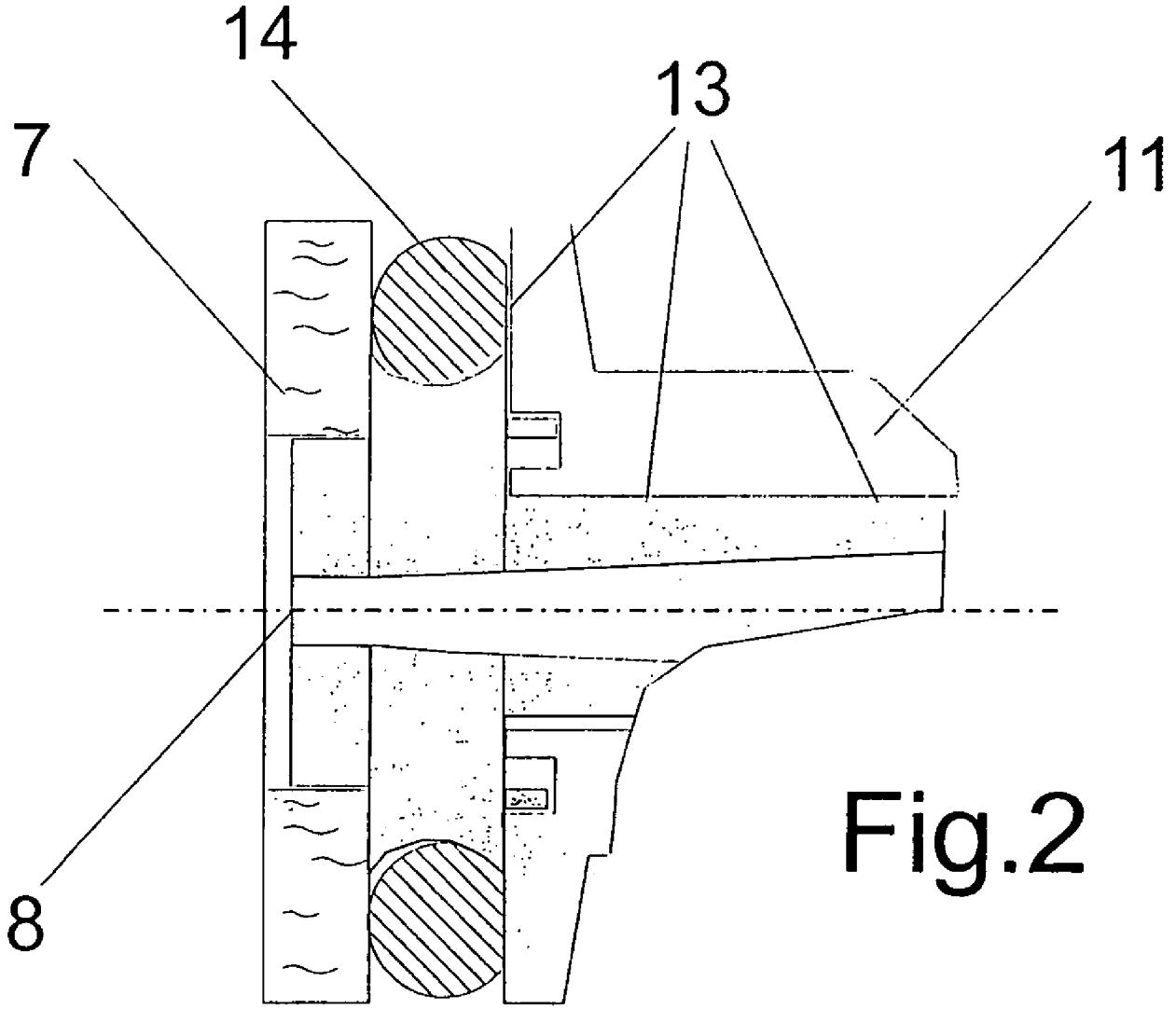
FIG. 2 shows the entrance area to the hollow cathode of the channel spark source.

For a long-term beam quality of the electron beam the dosed gas supply to the interior of the hollow cathode is very important. In the FIGS. 2 and 3, two possibilities for the dosing of the gas supply are shown:

The small gas supply volume is controlled by the flange at the beginning of the hollow cathode 1 that is between the hollow cathode 1 and the housing 7.

There is a seal O-ring 14 disposed between the housing 7 and the channel body 11 and the seal O-ring 14 is ground at the side thereof facing the hollow cathode 1 by sand paper having a 9 μm coarse grain so that a predetermined leakage providing for a small controlled gas leakage flow by way of the annular gap 13 into the hollow cathode is obtained.

The same result is obtained if the o-ring is ground between the hollow cathode and the channel spark body 11, at the side facing the hollow cathode, by sandpaper having a coarsity of 9 μm so that the seal is leaky in a controlled manner and the gas passes through the gap into the interior of the hollow cathode 1.

Figure 3:
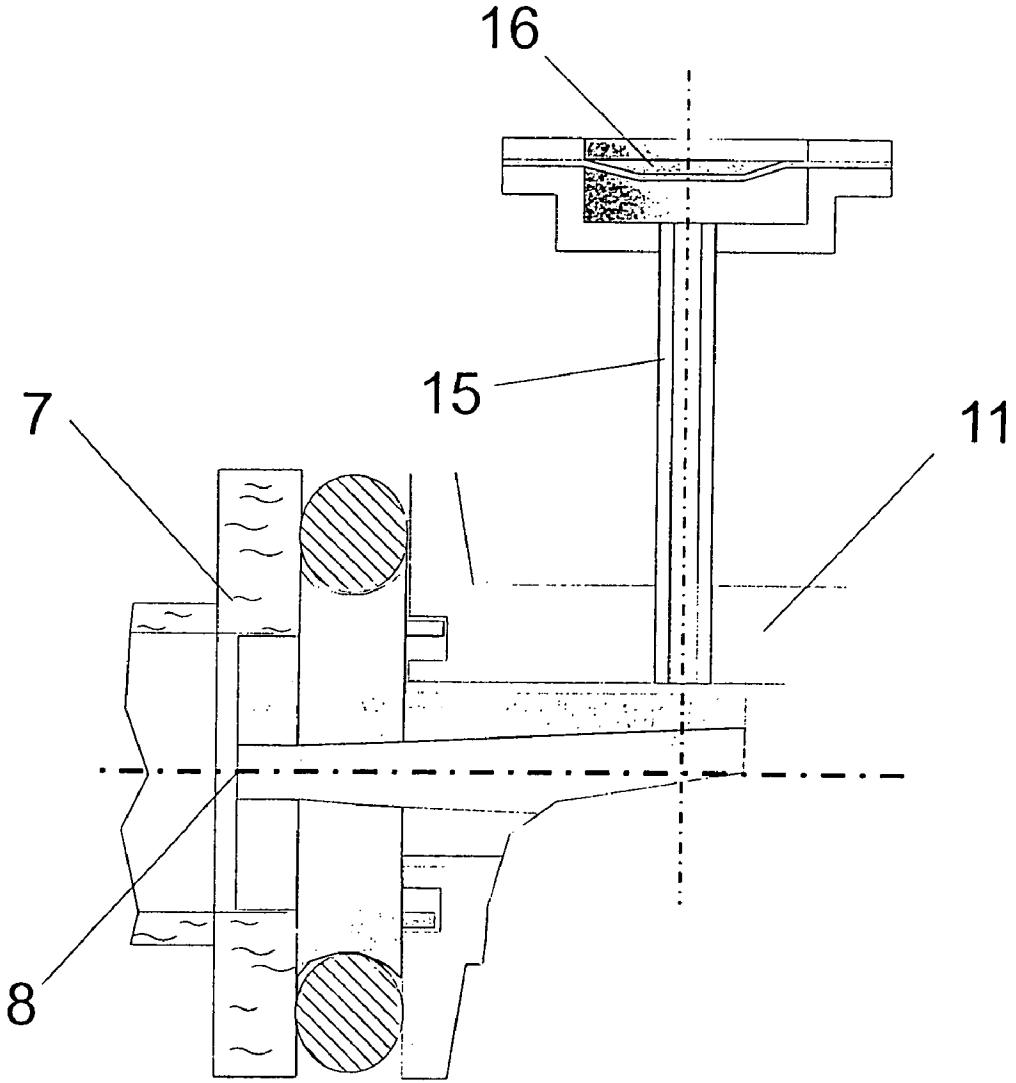
FIG. 3 shows a section of the hollow cathode with a gas supply controlled by a membrane.

Another possibility to obtain only a small gas flow to the cathode area is shown in FIG. 3. Here the dosed gas supply is achieved by the permeation of air, that is, the desired gas, through the plastic foil 16 by way of the pipe connection 15 to the hollow cathode 11. The amount of air or gas passing through the foil depends on one hand on the local pressure differential but also on the type of foil, the surface area of the foil or membrane 16, the foil thickness and the operating or, respectively, ambient temperature. In the present case, polyester was used as the foil material.

What is claimed is:

1. A channel spark source for generating a stable focused electron beam comprising a coaxial arrangement of:

a dielectric tube (7) in which a trigger plasma is generated, a hollow cathode (1) disposed axially adjacent the dielectric tube (7), a dielectric channel spark body (11) disposed with one end face adjacent the hollow cathode (1) and having an opposite end face disposed adjacent an anode (17) having a central passage, a dielectric end tube (5) extending from the anode and arranged in alignment with the dielectric channel spark body (11), a condenser connected as an electric energy storage between the anode (17) and the hollow cathode (1), an electrode (18) disposed at the end of the dielectric tube (7) remote from the hollow cathode (1) and extending into the trigger volume thereof, said electrode being connected to a reference potential by way of a spark discharge gap (19) and also to the hollow cathode (1) by way of electric resistor (20), a sleeve (21) extending into the hollow cathode (1) from the dielectric tube end thereof and having a central passage which widens conically toward the anode (17), said sleeve (21) forming part of the dielectric tube (1) and forming with the wall thereof an annular gap (13) which is closed at the end thereof adjacent the dielectric tube (7) and open at the end adjacent the channel spark body (11) and which ends in spaced relationship from the end of the hollow cathode (1) adjacent the anode (17) so that a rest volume with the inner diameter of the hollow cathode (1) remains in the hollow cathode (1) in communication with the hollow space, said hollow cathode (1) being provided with gas supply means for conducting a dosed amount of gas into the hollow cathode (1) in order to provide for a predetermined pressure differential between the hollow cathode exit and the dielectric tube exit, and a magnet disposed adjacent the dielectric tube (7) and having a magnetic field extending through the dielectric tube (7), said magnet being axially movable along the dielectric tube (7) and having a magnetic field axis which is pivotable relative to the axis of the dielectric tube (7).

2. A channel spark source according to claim 1, wherein the conically widening passage of the sleeve (21) has at the connecting point to the dielectric tube (7) and opening, and toward the entrance (10) of the channel spark body (11) has an opening corresponding to the entrance opening of the channel spark body (11) and the length of the sleeve (21) is between four and ten times the diameter of the channel spark tube (9).

3. A channel spark source according to claim 2, wherein the gas supply means includes a valve (16) consisting of a membrane which separates the interior of the hollow cathode (1) from a gas space of a pressure higher than that in the hollow cathode, said membrane permitting gas to pass in a dosed manner depending on the membrane structure, the pressure differential and the ambient temperature.

4. A channel spark source according to claim 3, wherein the membrane is a thermo-stable plastic foil consisting of one of polyester, polyvinyl chloride, silicon rubber and Teflon®.

5. A channel spark source according to claim 2, wherein the hollow cathode (1) is provided at its opposite ends with sealing structures and at least one of the end faces of the hollow cathode (1) is provided with a micro-unevenness forming leakage passages permitting dosed passage of gas into the hollow cathode.

6. A channel spark source according to claim 5, wherein the channels forming micro-unevenness are formed in O-rings forming a seal structure at the ends of the hollow cathode (1).

7. A channel spark source according to claim 2, wherein, for a dosed gas inlet, the gas supply is provided with a reduced cross-section area selected so as to provide for a predetermined leakage rate into the interior of the hollow cathode (1).

8. A channel spark source according to claim 2, wherein, for the dosed gas inlet, a valve is arranged in the gas supply so as to provide for a controllable leakage rate into the interior of the hollow membrane.

9. A channel spark source according to claim 1, wherein the magnet is an annular permanent magnet.

10. A channel spark source according to claim 1, wherein the magnet is a permanent magnet (12) provided with pole shoes arranged opposite each other at a distance corresponding to the diameter of the dielectric tube (7).

11. A channel spark source according to claim 1, wherein the magnet is an electromagnet with a flat spiral coil.

12. A channel spark source according to claim 1, wherein the magnet is an electromagnet comprising a coil wound around a gap-forming iron core.

* * * * *